United States Patent [19]

Long

[11] 4,149,053

[45] Apr. 10, 1979

[54] SAFETY DISCONNECT ELECTRIC SWITCH

[75] Inventor: Eric L. Long, Mequon, Wis.

[73] Assignee: Cutler-Hammer, Inc., Milwaukee, Wis.

[21] Appl. No.: 735,691

[22] Filed: Oct. 26, 1976

[51] Int. Cl.[2] ..... H01H 9/06

[52] U.S. Cl. ..... 200/157; 200/153 LA; 200/DIG. 42

[58] Field of Search ..... 200/157, 153 LA, DIG. 42, 200/248

[56] References Cited

U.S. PATENT DOCUMENTS

| | | | |
|---|---|---|---|
| 3,194,809 | 7/1965 | Epsteen | 200/DIG. 42 |
| 3,869,590 | 3/1975 | Hults | 200/157 |
| 3,953,699 | 4/1976 | Teichert | 200/DIG. 42 |

FOREIGN PATENT DOCUMENTS

| | | | |
|---|---|---|---|
| 1140261 | 11/1962 | Fed. Rep. of Germany | 200/DIG. 42 |

*Primary Examiner*—Harold Tudor

[57] ABSTRACT

A trigger switch for portable tools that provides safety disconnect under contact-weld conditions. The switch is a manual close, return spring open, double-snap type wherein the actuator acts on a double-inclined surface of a cam to snap the switch contacts closed or open as the actuator passes the center high point of the cam in one direction or the other. The safety disconnect feature provides in series with the switch contacts a connector biased to flip open that is normally held closed by actuator reactance force on the cam in combination with tripping means therefor. This tripping means includes coacting means between the cam and a contact carrier on which the cam is normally spring-restrained from shifting in the switch opening movement direction of the actuator. If the contacts weld, switch opening movement of the actuator under force of the stored energy of its return spring, and without requiring any additional external force, forcibly shifts the cam to a point allowing it to trip down in the contact carrier and release the connector allowing it to flip open and interrupt the connection permanently.

19 Claims, 7 Drawing Figures

Fig. 2
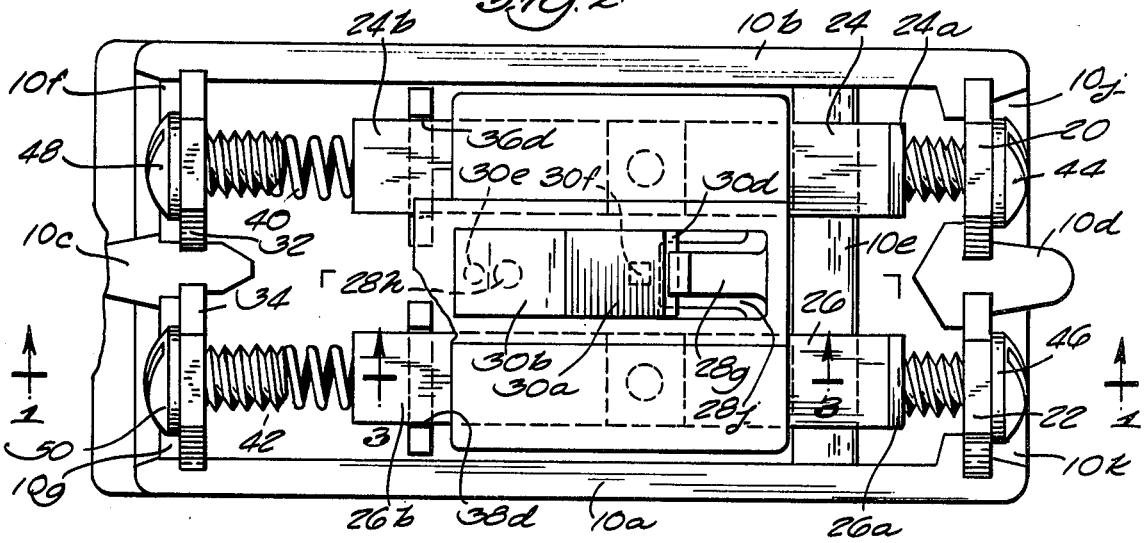
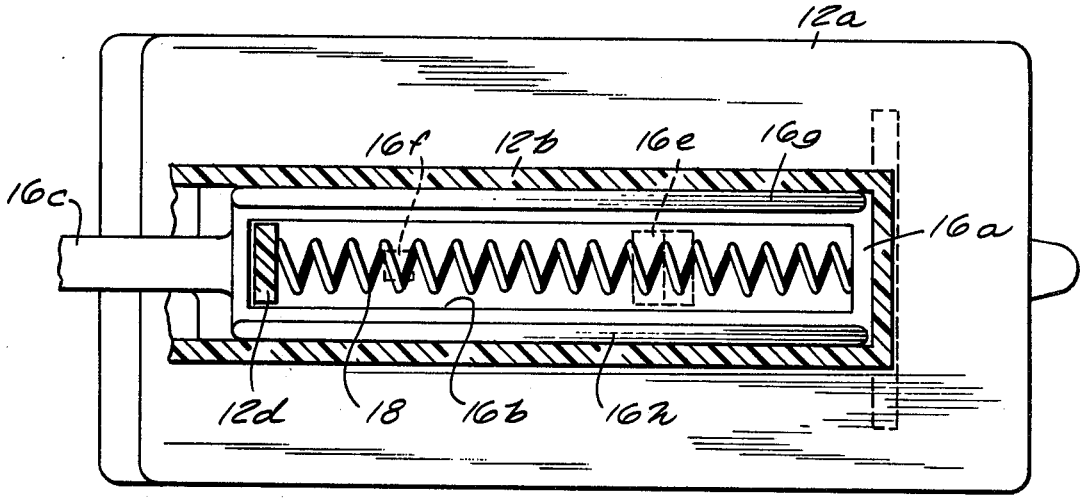
Fig. 4
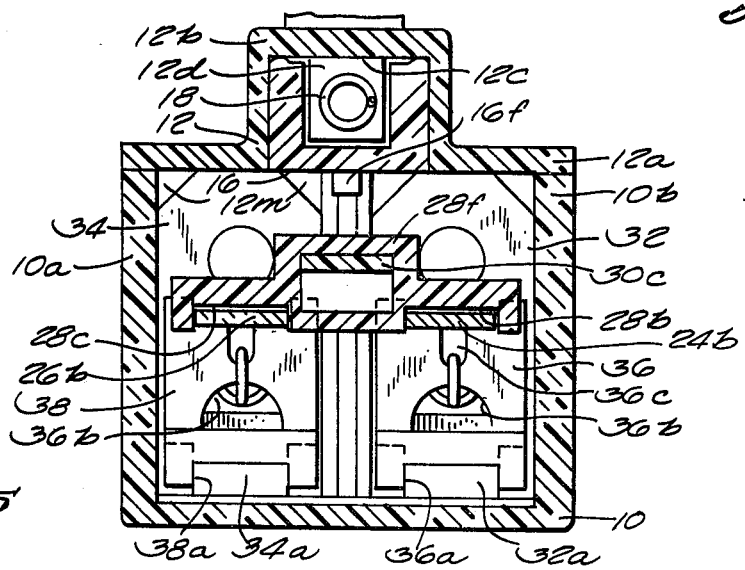
Fig. 5

Fig. 7
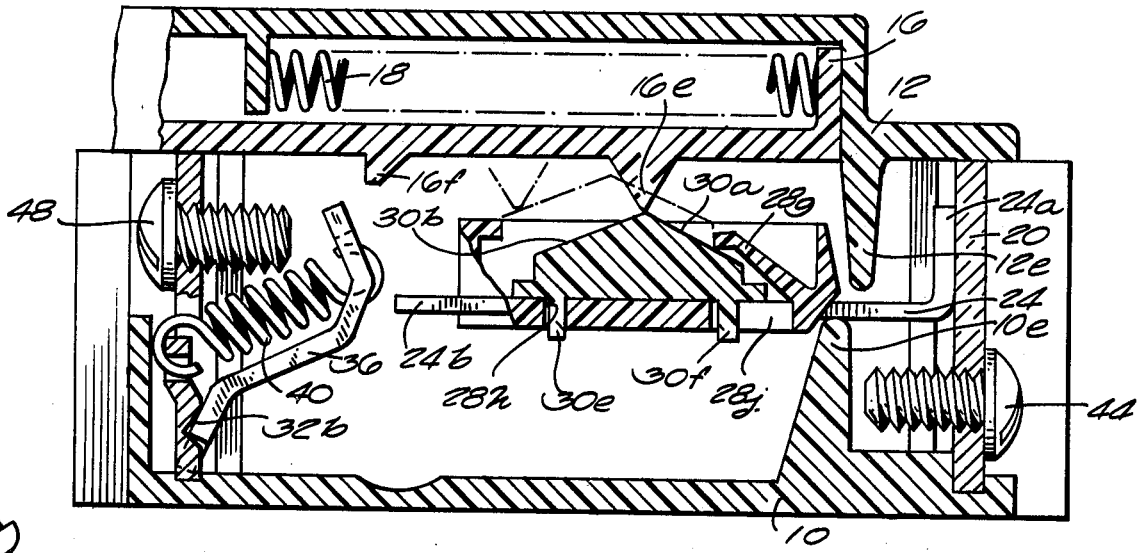
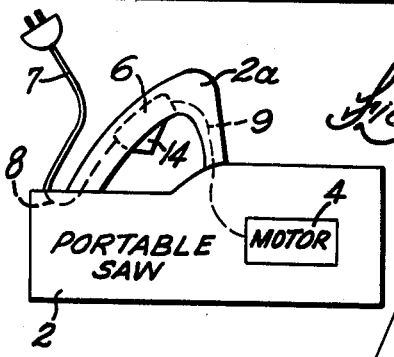
Fig. 8
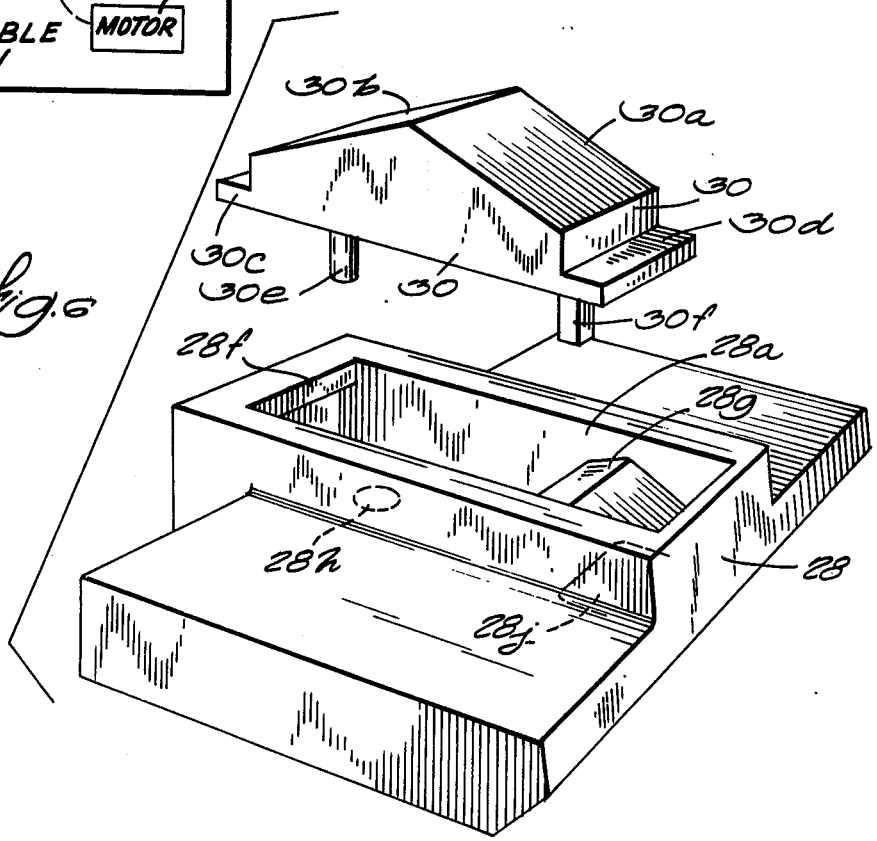
Fig. 6

SAFETY DISCONNECT ELECTRIC SWITCH

BACKGROUND OF THE INVENTION

Switches have been known heretofore that have included features affording opening thereof under contact sticking or welding conditions. For example, positive action switches such as shown in H. W. Hults U.S. Pat. No. 3,035,134, dated May 15, 1962 have been provided with an operating mechanism whereby the operating lever positively and unyieldingly transmits force to the movable contactor to provide shear for breaking any weld. While these prior switches have been useful for their intended purpose, this invention relates to a safety-disconnect switch that does not rely on forcibly opening welded contacts but instead opens a separate connection in the circuit under such conditions.

SUMMARY OF THE INVENTION

An object of the invention is to provide an improved safety-disconnect switch.

A more specific object of the invention is to provide a safety-disconnect switch that incorporates auxiliary means for interrupting the electrical connection under contact-weld conditions.

Another specific object of the invention is to provide a safety-disconnect switch that includes in series with the switch contacts a separable connector for actuation under contact-weld conditions.

Another specific object of the invention is to provide a switch of the manual close, return spring open type with safety-disconnect means such that the potential energy of the return spring is changed to kinetic energy to open the contacts under normal operation and such kinetic energy causes the switch to go into its safety-disconnect mode under contact-weld conditions.

Another specific object of the invention is to provide a safety-disconnect switch of the aforementioned type incorporating means for automatically opening said separable connector in response to opening movement of the switch actuator under contact-weld conditions and for preventing reclosure thereof when the switch actuator is released.

Another specific object of the invention is to provide a safety-disconnect switch of the aforementioned type incorporating means for snap-action opening of said separable connector and for maintaining the same open thereafter.

Other objects and advantages of the invention will hereinafter appear.

BRIEF DESCRIPTION OF THE DRAWINGS

FIG. 2 is a horizontal cross-sectional view taken substantially along line 2—2 of FIG. 1 to show the two poles of the double-pole switch and the safety-disconnect tripping mechanism;

FIG. 4 is a horizontal cross-sectional view taken substantially along line 4—4 of FIG. 1 to show the actuator return spring mechanism;

FIG. 5 is a lateral, vertical cross-sectional view taken substantially along line 5—5 of FIG. 1 to show the safety-disconnect, separable connectors associated with the respective poles of the switch;

FIG. 6 is a further enlarged, isometric, exploded view of the contact carrier and cam of the switch of FIGS. 1-5;

FIG. 7 is a cross-sectional view like FIG. 1 minus the trigger end portion but showing the switch in its welded-contact and safety-disconnect tripping position; and FIG. 8 is a schematic illustration of the manner of mounting and connecting the switch to a portable electric saw.

DESCRIPTION OF THE PREFERRED EMBODIMENT

Figures 1, 3:
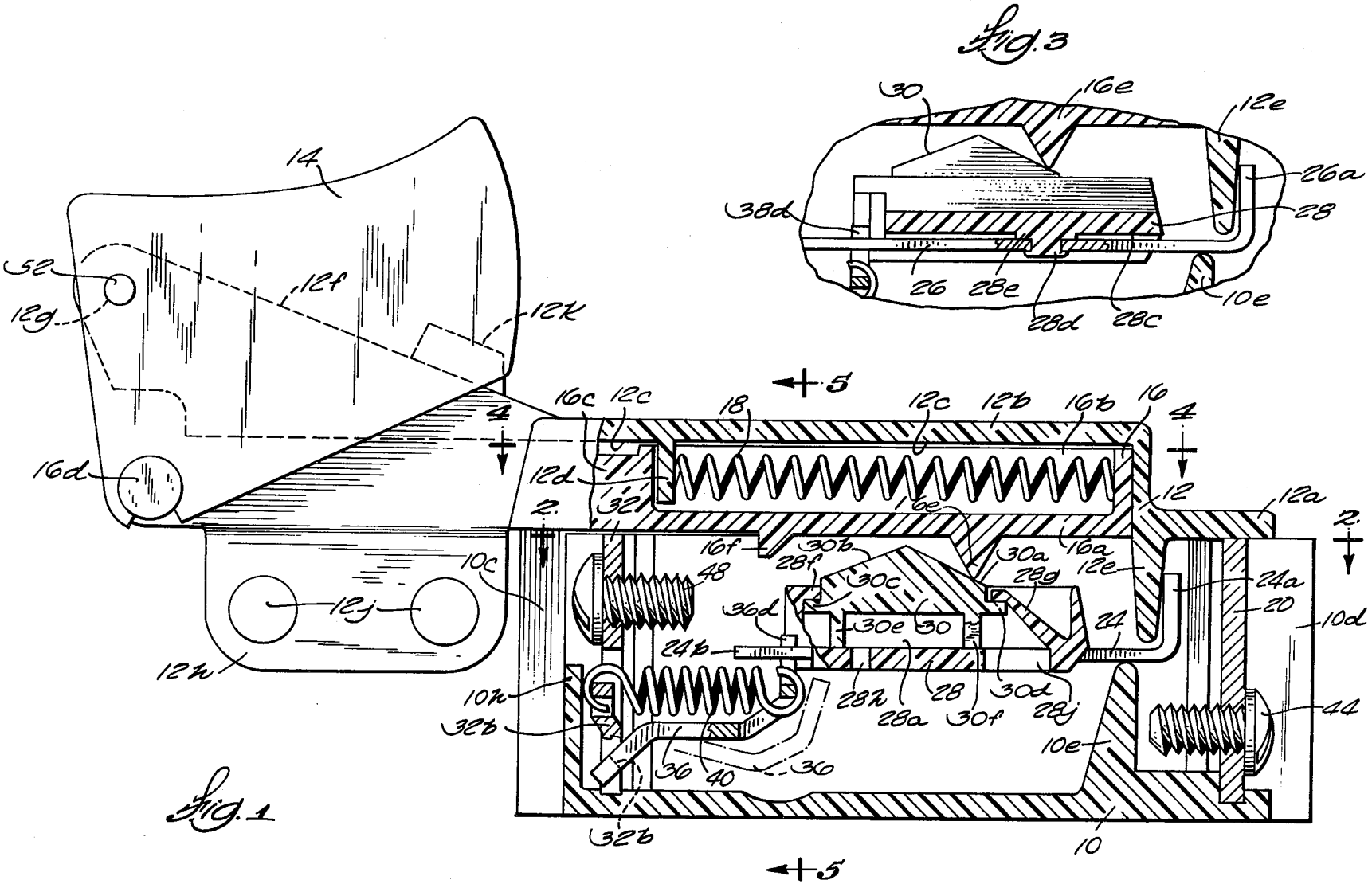
FIG. 1 is an enlarged, longitudinal, vertical, partial cross-sectional view of a trigger-operated safety-disconnect double-pole electric switch for industrial use taken substantially along line 1—1 of FIG. 2 to show the switch operating mechanism and safety-disconnect structure but with the trigger end portion being shown in elevation.
FIG. 3 is a fragmentary, vertical cross-sectional view taken substantially along line 3—3 of FIG. 2 to show the movable contact mounting and carrier structure.

Referring to FIG. 1, there is shown a safety-disconnect electric switch for industrial use constructed in accordance with the invention. As shown therein, this switch is of the double-pole, overhanging trigger type adapted to be mounted in the handle of a portable electric tool such as a drill, saw, or the like as shown in FIG. 8. As shown therein, portable electric saw 2 has a motor 4 for running the same and a handle 2*a* whereby it is grasped by the user. Switch 6 is mounted in this handle with its trigger 14 extending out to be depressed by the forefinger of the user in conventional manner. Motor 4 is powered from an electric source through plug and cord assembly 7 which is connected through switch 6 to the motor as indicated by broken lines 8 and 9 and as hereinafter more fully described. This switch comprises an insulating switch frame or housing 10, an insulating cover 12, a trigger 14, and a switch actuator 16 coupled to the trigger and biased from the cover by a helical return spring 18.

Housing 10 encloses the double-pole switch mechanism which comprises a pair of stationary contacts 20 and 22 shown in FIG. 2 at the right-hand end of the housing, a pair of movable butt contacts 24 and 26, an insulating contact carrier 28 supporting the movable contacts, a follower cam 30 for snap-action operation of the contacts and supported on the contact carrier, a pair of terminals 32 and 34 shown in FIG. 2 at the left-hand end of the housing, a pair of pivot hinges 36 and 38 shown in FIGS. 1 and 5, and a pair of helical tension springs 40 and 42 for the dual purpose of providing resilient force for the snap-action mechanism and for providing bias force for actuating the safety-disconnect mechanism in the event the contacts weld.

In addition, the switch is provided with means for connecting it to an external circuit. This means comprises a pair of terminal screws 44 and 46 for attaching electrical conductors to terminals of stationary contacts 20 and 22, respectively, and a pair of terminal screws 48 and 50 for attaching electrical conductors to terminals 32 and 34, respectively. One pair of these terminals may be connected to an electric source while the other pair thereof is connected to a load device.

As shown in FIGS. 1, 2 and 5, molded plastic housing 10 is generally rectangular in shape and is provided with a bottom, elongated front and rear walls 10*a* and 10*b*, and relatively shorter left and right end walls 10*c* and 10*d*, respectively, providing a compartment for the switch mechanism. To serve as a pivot for the movable contacts, there is provided an integrally molded upstanding ridge 10e extending up from the bottom of the housing and all the way across from front wall 10a to rear wall 10b and spaced slightly clear of screws 44 and 46 to support the movable contacts in both their open and closed positions. The left end wall of the housing is provided with a pair of spaced apertures 10f and 10g, FIG. 2, each having a continuous groove along its front, bottom and rear sides and being open at the top through which the respective terminal 32, 34 is slid down for retention therein by the cover as hereinafter described. As shown in FIG. 1, the terminal screws are threaded through the upper portions of the terminals such as 32 and these terminals are spaced inwardly from the end of the housing so that the extreme end of the housing may be provided with a half-height wall 10h to shield the pivot hinge and bias-spring-mounting, lower portion of the terminals while leaving the upper portions of the apertures open for access to the heads of the terminal screws. The right end wall of the housing is also provided with a pair of spaced apertures 10j and 10k as shown in FIG. 2, each having a continuous groove along its front, bottom and rear sides and being open at the top through which the respective movable contact is slid down for retention therein by the overlying cover as hereinafter described. The terminal screws such as 44 shown in FIG. 1 extend through the lower portions of the stationary contacts to provide space at the upper portions thereof for engagement by the movable contacts.

Cover 12 is provided with a generally flat portion 12a coextensive with the top of the housing as shown in FIGS. 4 and 5 for closing the top of the housing and is secured to the latter by known means such as, for example, ultra-sonic welding or the like. This cover is also provided with an inverted channel portion 12b extending longitudinally along its midportion and rising above its flat portion 12a and having a downwardly opening channel 12c therealong for accommodating actuator 16 and guiding the latter in its reciprocal operation. A tab 12d extends down from the cover centrally within channel 12c into the trough 16b in actuator 16 to serve as an abutment for one end of return spring 18 while the other end thereof is depressed by the actuator as hereinafter described. Cover 12 is also provided with an integrally molded, depending plate 12e extending down into the switch compartment and extending substantially all the way thereacross to serve as a stop for the movable contacts in their open position as shown in FIG. 1.

In addition, cover 12 is provided with an extension affording switch supporting and trigger pivoting means. This trigger pivoting means comprises an inclined portion 12f extending at an upward angle above channel 12c and having a lateral hole 12g at its tip to which trigger 14 is pivoted by a pivot pin 52 passing therethrough and through a pair of holes in the two sides of the generally U-shaped trigger aligned with hole 12g. The switch supporting means comprises a forwardly-offset plate 12h extending downwardly from the cover extension below the trigger and having a pair of spaced holes 12j therein by which the switch may be mounted in the handle of a portable tool. A lug 12k is provided on inclined portion 12f to serve as a stop to limit trigger depression. A pair of 45 degree angular lugs such as 12m in FIG. 5 are provided for engaging each complementarily-formed stationary contact and terminal to retain it in place.

The switch is provided with means for supporting the movable contacts and for snap-action movement thereof between closed and open positions with respect to the stationary contacts when the trigger is operated. This means comprises insulating contact carrier 28 shown in FIGS. 1–3, 5 and 6. This contact carrier comprises a generally flat molded plastic member having a raised trough 28a along its upper center portion for accommodating cam 30 and a pair of spaced grooves 28b and 28c along its lower surface on opposite sides of the bottom of the trough for retaining movable contacts. For this purpose, each such groove has a round projection integrally molded therein which extends through a corresponding hole in the movable contact and is spread over to form a rivet 28d as shown in FIG. 3 to secure the movable contact to the contact carrier, there being a low "land" 28e across the groove at the root of the rivet to space the opposite end portions of the movable contact slightly from the bottom of the groove as shown in FIG. 3 thereby to avoid the requirement for close tolerance manufacture of these parts.

As shown in FIGS. 1 and 2, each of the movable contacts 24 and 26 comprises a flat strip of good electrically conducting metal such as copper, brass, or the like and has a 90 degree upwardly bent portion 24a, 26a near one end to form a contacting portion for engaging the corresponding stationary contact. As shown in FIG. 1, the movable contacts extend through the slot between plate 12e and ridge 10e and pivotally rest on ridge 10e while plate 12e forms a stop for the upwardly bent portions thereof in the contact open position.

The tail ends 24b and 26b of the movable contacts are supported by a mechanism that not only provides the necessary upward bias thereon and allows resilient depression thereof for snap-action operation of the contacts but also provides automatic safety-disconnect opening of the two circuits in the event the contacts should weld. This mechanism comprises the pair of like pivot hinges 36 and 38 and respectively cooperating tension springs 40 and 42. As shown in FIG. 1, these pivot hinges are pivotally supported on terminals 32 and 34, and are biased in a counter-clockwise direction by tension springs 40 and 42, respectively. For this purpose, each terminal 32 and 34 is provided with a reduced-width portion 32a, 34a at its lower end as shown in FIG. 5. This reduced-width portion has a horizontal notch 32b, 34b on its right-hand surface as shown in FIGS. 1, 5 and 7. For pivotal cooperation with such notch, each pivot hinge 36 and 38 has a rectangular slot 36a, 38a at its left end as shown in FIG. 1 providing a pair of spaced legs which straddle the reduced portion of the terminals as shown in FIG. 5 while the bottom of this slot engages the notch in the terminal to pivotally support the pivot hinge thereon as shown in FIGS. 1 and 7.

To support bias spring 40, terminal 32 has a cutout with an outwardly offset tongue 32c extending thereinto as shown in FIG. 1. This tongue has a hole into which one end hook of spring 40 is engaged. Spring 42 is similarly connected to terminal 34.

The other end of spring 40 is connected to pivot hinge 36 to bias it counterclockwise. For this purpose, pivot hinge 36 is provided with an aperture 36b at its upward bend as shown in FIGS. 1 and 5 and a slot 36c directly above such aperture providing a narrow section therebetween to which the other end hook of spring 40 is attached. Pivot hinge 38 is provided with a similar aperture 38b and slot 38c for attaching the other end hook of tension spring 42 to the narrow section therebetween.

The upwardly bent end of pivot hinge 36 is provided with a shallow rectangular slot **36*d* defined by two spaced upstanding lugs for retaining and supporting the aforesaid tail end 24*b* of movable contact 24 as shown in FIGS. 1, 2 and 5. The upper end of pivot hinge 38 is provided with a similar shallow rectangular slot 38*d* for retaining and supporting the tail end 26*b* of movable contact 26**.

The switch is provided with means affording snap-action operation of the movable contacts and for alternatively tripping the safety-disconnect mechanism in the event the contacts should weld. This means comprises cam 30 positioned in trough **28*a* in contact carrier 28 as shown in FIG. 1. This cam is provided with a double-inclined upper surface having a right incline 30*a* and a left incline 30*b* joined at a center high point for sliding engagement by the actuator as hereinafter described. This cam is also provided with flat front and rear walls as shown in FIG. 6 whereby it is confined between contiguous, flat front and rear inner walls of trough 28*a* in the contact carrier as shown in FIG. 2 affording longitudinal sliding thereof in the trough without tipping as hereinafter described. The left end of this cam has a short, flat and wide projection 30*c* shown in FIGS. 1, 5 and 6 held under ledge 28*f* at the left end of trough 28*a* as seen in FIG. 1 to securely hold this end of the cam to the contact carrier. This is necessary because in normal operation actuator 16 actuates the cam with snap-action and the cam moves the contact carrier therewith. The right end of this cam has a similar short flat projection 30*d* shown in FIGS. 1, 2 and 6 held under a resilient integrally-molded tongue or spring member 28*g* extending angularly up from the right, lower end corner of the trough in the contact carrier. The purpose of this integral spring member 28*g* is to maintain the cam normally in its leftward position within the trough as shown in FIG. 1 but to permit forcible movement of this cam to the right in the event the contacts weld as shown in FIG. 7. While an integrally-molded spring member 28*g* has been shown, it will be apparent that other means such as, for example, an helical compression spring between the cam and the right internal wall of trough 28** could be used in place thereof.

Cam 30 is further provided with means coacting with contact carrier 28 affording sudden downward tripping of the cam in response to return movement of the actuator in the event the contacts are welded to open the safety-disconnect connector as shown in FIG. 7. This means comprises a pair of spaced legs **30*e* and 30*f* extending down from the bottom of the cam along the longitudinal axis thereof as shown in FIGS. 1, 2 and 6. Leg 30*e* is round and leg 30*f*** is square and the lower ends thereof rest on the bottom of the trough in the contact carrier.

To allow the cam to drop down into the trough upon tripping, a pair of spaced holes **28*h* and 28*j* are provided in the bottom of the contact carrier as shown in FIGS. 1, 2 and 7. Hole 28*h* is round and large enough to freely receive round leg 30*e*. Hole 28*j* is substantially rectangular as shown in FIG. 2 to provide a definite and accurately-defined slip-off edge for square leg 30*f*. Holes 28*h* and 28*j* which are larger than legs 30*e* and 30*f* are spaced apart such that their left slip-off edges are the same distance apart as the left slip-off edges of legs 30*e* and 30*f*. In this way, both legs will drop in their holes simultaneously on tripping while square leg 30*f* along with the left edge of rectangular hole 28*j*** accurately determines the point of cam movement at which it will occur.

The switch is provided with means for actuating follower cam 30. This means comprises actuator 16 which is an elongated insulating molded plastic member. As shown in FIG. 4, this actuator has an enlarged right half **16*a* providing a trough 16*b* therein for accommodating return spring 18 and abutment tab 12*d* of the cover. As shown in FIG. 1, one end of spring 18 abuts the right end wall of trough 16*b* while the other end of the spring is stopped against stationary tab 12*d*. This actuator has a narrower left half 16*c* extending along channel 12*c* in the cover and terminating in a pair of opposed, lateral journals, one, 16*d*, of which is shown in FIG. 1, to which the opposite sides of the generally U-shaped trigger 14** are rotatably coupled, thereby to translate pivotal motion of the trigger to linear motion of the actuator.

Actuator 16 is also provided with a driver lug **16*e* extending down from the bottom of enlarged right-half 16*a* thereof into engagement with the inclined surface of follower cam 30. This driver lug 16*e* has a generally V-shaped contour and extends at least all the way across the cam which it drives as shown in dotted lines in FIG. 4**.

Actuator 16 is further provided with a stop lug **16*f* spaced toward the left from driver lug 16*e* as shown in FIG. 1. This stop lug is narrower than the driver lug as shown in dotted lines in FIG. 4 and has a vertical left edge for abutting against the inner surface of the left end wall 10*c* of the housing to limit actuator movement when the trigger is depressed. Rounded ridges 16*g* and 16*h* shown in FIG. 4 on the upper edges of actuator 16 on the opposite sides of trough 16*a*** reduce the friction against the cover.

The operation of the switch will now be described. When the aforementioned tool handle is gripped and trigger 14 is depressed by the forefinger of the user, it swings clockwise as seen in FIG. 1 and pulls actuator 16 linearly toward the left. Return spring 18 is compressed and driver lug **16*e* slides along inclined surface 30*a* of cam 30. For this to happen, since driver lug 16*e* cannot move up, cam 30 must move down. Therefore, as driver lug 16*e* moves up incline 30*a*, cam 30 and contact carrier 28 and movable contacts 24 and 26 secured to the latter swing counterclockwise with the movable contacts pivoting on ridge 10*e*. As the tail ends of the movable contacts swing down, pivot hinges 36 and 38 pivot clockwise as indicated by the broken lines in FIG. 1 and stretch springs 40 and 42 until driver lug 16*e* passes over the center high point between the inclined surfaces of the cam. As this occurs, the upward bias of springs 40 and 42 causes the cam to be accelerated in the right hand direction with a snap-action as driver lug 16*e* slides down inclined surface 30*b*. This cam moves the contact carrier with it to close upwardly bent portions 24*a* and 26*a* of the movable contacts against stationary contacts 20 and 22. This causes two connections to be closed through the respective two poles of the switch from screw 44 to screw 48 and from screw 46 to screw 50** to connect the tool motor to the power supply.

When the trigger is released, actuator 16 returns toward the right under the force of return spring 18. Driver lug **16*e* slides up incline 30*b* while the movable contacts pivot on ridge or fulcrum 10*e* and bias springs 40 and 42** are stretched and after passing the high point, snaps the cam back in the leftward direction to open the contacts and disconnect the tool motor from the power supply. This pivoting of the movable contacts tends to break any small welds thereon by torsional and shear action.

Now let it be assumed that the contacts have been closed as hereinbefore described and have welded to one another. This might occur due to arcing and overheating of the movable and stationary contacts surfaces causing melting and fusing of the metal to weld one or both of the movable contacts to the respective stationary contacts. When the trigger is released in an attempt to open the contacts and driver lug 16*e* attempts to slide up inclined surface 30*b* as shown in broken lines in FIG. 7, the cam, the contact carrier and the tail ends of the movable contacts cannot swing down. This is for the reason that one or both of upwardly bent contacting portions 24*a* and 26*a* are welded to stationary contacts 20 and 22 and the movable contacts cannot pivot on ridge 10*e*. As a result, driver lug 16*e* forces cam 30 rightwardly against the force of spring 28*g* until the cam trips down when its legs 30*e* and 30*f* suddenly drop into holes 28*h* and 28*j* in the bottom of the contact carrier. This relieves the downward restraining force on the cam enough so that, due to the length and resiliency of the movable contacts and spacing of plate 12*e* therefrom, bias springs 40 and 42 are able to flip pivot hinges 36 and 38 up clear of tail ends 24*b* and 26*b* of the movable contacts to break the connections. More specifically, as shown in FIG. 1, since plate 12*e* of the cover does not abut the upper surface of the movable contacts and each movable contact is secured at a single point, rivet 28*d* shown in FIG. 3, to the contact carrier, the movable contacts will flex upwardly under the force of bias springs 40 and 42 since these contacts are resilient, causing the tail ends of these contacts to rise the small amount needed to allow pivot hinges 36 and 38 to rotate counter-clockwise free thereof. These bias springs then maintain the connections open permanently to overcome all danger of completion of the circuit. The lower ends of these pivot hinges remain confined in the notches in the terminals or pressed against the bottom of the housing so that they cannot fall loose and inadvertently touch the movable contacts. As a result, the connection has been opened in a safety-disconnect manner despite the failure of the contacts to open in their normal manner. The switch must then be replaced in order to reoperate the tool since the safety-disconnect connectors cannot be reclosed by external means. While this requires replacement of the switch, it also provides the utmost in safety-disconnect opening of the circuit.

While the apparatus hereinbefore described is effectively adapted to fulfill the objects stated, it is to be understood that the invention is not intended to be confined to the particular preferred embodiment of safety-disconnect electric switch disclosed, inasmuch as it is susceptible of various modifications without departing from the scope of the appended claims.

I claim:

1. A safety-disconnect electric switch comprising:

an insulating housing; and means providing a controllable electric connection through said switch within said housing comprising:

stationary contact means mounted in said housing;

movable contact means in said housing arranged to close and open with respect to said stationary contact means to complete and interrupt said electric connection;

switch operating means for said movable contact means for closing and opening the same;

safety-disconnect connector means in said electric connection biased to open but normally held closed by said switch operating means;

and tripping means in said switch operating means normally restrained but movable in response to actuation of said switch operating means in attempted opening of said movable contact means under welded-contact conditions to afford tripping thereof to release said biased safety-disconnect connector means to cause it to open and interrupt said electric connection.

2. The safety-disconnect electric switch claimed in claim 1, wherein said safety-disconnect connector means in said electric connection biased to open but normally held closed by said switch operating means comprises:

a pivot hinge comprising a member pivoted at one end and supporting said movable contact means at its other end;

and a spring biasing said member in a direction tending to flip it free of said movable contact means;

and said movable contact means normally restraining said pivot hinge member under the control of said switch operating means.

3. The safety-disconnect electric switch claimed in claim 1, wherein said switch operating means for said movable contact means for closing and opening the same comprises:

a switch actuator mounted for movement with respect to said housing;

a contact carrier having said movable contact means mounted thereon;

a snap-action cam on said contact carrier;

and means biasing said cam against said switch actuator whereby movement of the latter causes snap-action operation of said movable contact means.

4. The safety-disconnect electric switch claimed in claim 3, wherein said switch operating means for said movable contact means for closing and opening the same also comprises:

return spring means for restoring said switch actuator to normally open contacts position upon release following operation thereof;

and manual means for operating said actuator to its closed contacts operating position against the force of said return spring means;

and the potential energy of said return spring means being changed to kinetic energy to open said contact means under normal operation and such kinetic energy causing said tripping means to go into a safety-disconnect mode under welded-contacts conditions to interrupt said electric connection.

5. An electric switch that affords safety-disconnect under welded-contact conditions comprising:

an insulating housing;

a double-pole switch comprising a pair of stationary contacts mounted in said housing including terminal means for connecting said stationary contacts to an external circuit, and a pair of movable contacts in said housing and means mounting said movable contacts for closing and opening with respect to said stationary contacts to complete and interrupt a double-pole electric connection;

switch operating means for said movable contacts for closing and opening the same;

a pair of terminals mounted in said housing including means for connecting the same to an external circuit;

safety-disconnect connector means in said housing connected to said pair of terminals and normally slidingly supporting said movable contacts in electrical connection therewith, being biased to flip free of said movable contacts under welded-contact conditions but being normally restrained thereby;

and tripping means in said switch operating means normally restrained but movable in response to actuation of said switch operating means in attempted opening of welded contacts to cause tripping thereof to relieve the restraint of said movable contacts on said safety-disconnect connector means thereby to allow said safety-disconnect connector means to flip free of said movable contacts and interrupt said double-pole electric connection.

6. The electric switch that affords safety-disconnect under welded-contact conditions claimed in claim 5, wherein:

said safety-disconnect connector means comprises a pair of pivot member, each pivoted at one end to a respective one of said terminals, and a pair of tension springs, each connected between the other end portion of the respective pivot member and the respective terminal to bias such pivot member against the respective movable contact.

7. The electric switch that affords safety-disconnect under welded-contact conditions claimed in claim 5, wherein said switch operating means comprises:

a trigger movably mounted to said housing;

a switch actuator responsive to movement of said trigger for performing a resultant movement;

an insulating contact carrier to which said pair of movable contacts are rigidly secured in spaced apart relation;

a follower cam supported on said contact carrier;

means biasing said follower cam against movement in the contact opening direction of movement of said actuator relative to said contact carrier whereby said contact carrier normally moves in both the contact closing and contact opening directions of movement in unison with said follower cam but allows movement of said follower cam against said biasing means under welded-contact conditions to activate said tripping means;

and a driver lug on said switch actuator engaging said follower cam to cause snap-action movement of said cam in response to predetermined movement of said switch actuator.

8. The electric switch that affords safety-disconnect under welded-contact conditions claimed in claim 7 wherein:

said means biasing said follower cam comprises a resilient finger between said contact carrier and said follower cam.

9. The electric switch that affords safety-disconnect under welded-contact conditions claimed in claim 8, wherein:

said resilient finger is an integrally molded part of said insulating contact carrier.

10. The electric switch that affords safety-disconnect under welded-contact conditions claimed in claim 7, wherein:

said means biasing said follower cam is a compression spring between said contact carrier and said follower cam.

11. The electric switch that affords safety-disconnect under welded-contact conditions claimed in claim 7, wherein:

said follower cam comprises a double-inclined cam surface having a center high point affording snap-action closing and opening of the movable contacts when said driver lug passes said high point in opposite directions, respectively.

12. The electric switch that affords safety-disconnect under welded-contact conditions claimed in claim 7, wherein:

said movable contacts comprise like, elongated strip members, each being secured at its intermediate portion to said contact carrier and having a bend adjacent one end forming a contacting portion for closing with the respective stationary contact, and having a tail end portion at its other end supported by said safety-disconnect connector means.

13. The electric switch that affords safety-disconnect under welded-contact conditions claimed in claim 12, wherein:

said means mounting said movable contacts comprises a lateral ridge in said housing providing a fulcrum for supporting said movable contact strip members near their bent ends for pivotal and sliding movement thereon toward said stationary contacts.

14. The electric switch that affords safety-disconnect under welded-contact conditions claimed in claim 7, wherein:

said switch operating means also comprises a return spring between said housing and said switch actuator for returning said switch actuator to normal position upon release following depression of the trigger.

15. The electric switch that affords safety-disconnect under welded-contact conditions claimed in claim 14, wherein:

the potential energy of said return spring is changed to kinetic energy to operate said switch actuator and said follower cam to open the contacts under normal conditions and such kinetic energy causing operation of said switch actuator to operate said follower cam into safety-disconnect mode activating said tripping means and interrupting said electric connection under welded-contact conditions.

16. In combination with an electric tool having a housing including a handle portion that is gripped during use of the tool and an electric motor for driving the tool:

a safety-disconnect electric switch mounted in said handle portion including an operating lever extending therefrom for actuation by the hand of the user to connect said tool motor to a power supply to run the tool and to disconnect said tool motor therefrom to stop the tool comprising:

an insulating switch housing having electric terminals thereon connected to said motor and said power supply; and means providing a controllable electric connection between said terminals comprising:

stationary contact means mounted in said switch housing;

movable contact means within said switch housing arranged to close and open with respect to said stationary contact means normally to complete and interrupt said electric connection to control running of said tool;

switch actuator means movable responsive to said operating lever to close said contact means and being restorable to normally reopen said contact means;

safety-disconnect connector means in said electric connection biased to open but normally held closed by said switch actuator means;

and tripping means in said switch actuator means normally restrained but movable in response to actuation of said switch actuator means in attempted opening of said movable contact means under welded-contact conditions to afford tripping thereof to release said biased safety-disconnect connector means to cause it to open and interrupt said electric connection to stop the tool.

17. The combination claimed in claim 16, wherein:

said switch actuator means comprises a return spring to restore it to "off" position after it has been actuated to "on" position by said operating lever;

and said return spring restores said switch actuator means to operate said tripping means under welded-contact conditions.

18. In combination with a portable electric circular saw having a housing including a handle portion that is gripped during use of the saw and a current carrying conductor supplied from a power source and an electric motor connected thereto and mounted within said housing for driving the circular saw blade;

a safety-disconnect electric switch wired in series connection with said conductor and electric motor and mounted in said handle portion and including an operating lever extending therefrom for actuation by the hand of the user concurrently with use of the circular saw to connect said tool motor to said electric power source to run the circular saw and to disconnect said tool motor therefrom to stop the circular saw comprising:

an insulating switch housing having terminals thereon connected to said motor and said power source; and means providing a controllable electric circuit between said terminals comprising:

stationary contact means mounted in said switch housing;

movable contact means within said switch housing arranged to close and reopen with respect to said stationary contact means normally to turn said circular saw "on" and "off";

switch actuator means movable responsive to said operating lever to close said contact means and including a return spring operable upon release of said operating lever to restore said switch actuator means to normally reopen said contact means;

safety-disconnect connector means in said electric circuit biased to open but normally held closed by said switch actuator means;

and tripping means in said switch actuator means normally restrained but movable in response to actuation of said switch actuator means in attempted opening of said movable contact means under welded-contact conditions to afford tripping thereof to release said biased safety-disconnect connector means to cause it to open and interrupt said electric circuit to insure that said circular saw will stop when said operating lever is released and cannot be restarted until the faulty switch is replaced.

19. The combination claimed in claim 18, wherein:

said safety-disconnect connector means comprises a snap-action interrupter in series with said contact means in said controllable electric circuit that snaps open free of said switch actuator means.

* * * * *